US008561801B2

(12) United States Patent
Grenchus, Jr. et al.

(10) Patent No.: US 8,561,801 B2
(45) Date of Patent: Oct. 22, 2013

(54) MACHINERY PACKAGING SYSTEM

(75) Inventors: Edward J. Grenchus, Jr., Vestal, NY (US); Stephane G. Laforge, Neuilly-sur-Seine (FR)

(73) Assignee: International Business Machines Corporation, Armonk, NY (US)

( * ) Notice: Subject to any disclaimer, the term of this patent is extended or adjusted under 35 U.S.C. 154(b) by 117 days.

(21) Appl. No.: 13/223,725

(22) Filed: Sep. 1, 2011

(65) Prior Publication Data

US 2013/0032506 A1 Feb. 7, 2013

(30) Foreign Application Priority Data

Aug. 1, 2011 (EP) ..... 11290353

(51) Int. Cl.
*B65D 81/02* (2006.01)

(52) U.S. Cl.
USPC ..... 206/586; 206/453

(58) Field of Classification Search
USPC ..... 206/521, 586, 523, 453, 594; 53/472
See application file for complete search history.

(56) References Cited

U.S. PATENT DOCUMENTS

| | | | | |
|---|---|---|---|---|
| 3,302,782 | A | 2/1967 | Pezely, Jr. | |
| 3,444,313 | A | 5/1969 | Goodchild et al. | |
| 3,836,043 | A | 9/1974 | Levin | |
| 3,879,774 | A | 4/1975 | Glasser et al. | |
| 4,292,901 | A * | 10/1981 | Cox | 108/55.1 |
| 5,050,693 | A | 9/1991 | Wirth et al. | |
| 5,115,917 | A * | 5/1992 | Schrage | 206/586 |
| 5,127,526 | A | 7/1992 | Vigue | |
| 5,259,508 | A | 11/1993 | Beckerman | |
| 5,297,682 | A | 3/1994 | Miltenberger | |
| 5,366,080 | A | 11/1994 | Carstersen et al. | |
| 5,611,426 | A | 3/1997 | Warfield | |
| RE35,677 | E | 12/1997 | O'Neill | |
| 5,992,812 | A | 11/1999 | Mark | |
| 6,155,527 | A | 12/2000 | Muyskens | |
| 6,311,945 | B1 | 11/2001 | D'Angelo | |
| 6,318,692 | B1 | 11/2001 | Cyrell | |
| 6,464,197 | B1 | 10/2002 | Chen | |

(Continued)

FOREIGN PATENT DOCUMENTS

FR 2691435 A1 * 11/1993

OTHER PUBLICATIONS

Cummins et al., "Boxing Machine", IBM Technical Disclosure Bulletin, RDB 09-85 pp. 1459-1466, Feb. 19, 2005.

*Primary Examiner* — David Fidei
(74) *Attorney, Agent, or Firm* — Yee & Associates, P.C.; David A. Mims, Jr.

(57) ABSTRACT

A packaging system and method for packaging a piece of machinery are provided. A first corner bracket is extended from a first exterior edge of the machinery. The first corner bracket comprises a first baseplate positioned along a bottom plane of the machinery, and a first plurality of side plates. Each of the first plurality of side plates is integrally attached to the first baseplate at a first angle. Each of the first plurality of side plates extends upwardly from the baseplate. Each of the first plurality of side plates is integrally attached to at least one other of the first plurality of side plates. The first plurality of side plates form a first interior edge that mates to the first exterior edge of the machinery.

14 Claims, 6 Drawing Sheets

(56) References Cited

U.S. PATENT DOCUMENTS

| | | | | |
|---|---|---|---|---|
| 6,837,378 | B2 | 1/2005 | Mason et al. | |
| 7,347,911 | B2 | 3/2008 | Selle et al. | |
| 7,587,790 | B2 | 9/2009 | McCue et al. | |
| 8,240,533 | B2 | 8/2012 | Wetsch | |
| 2005/0092634 | A1 * | 5/2005 | Baechle | 206/320 |
| 2007/0000289 | A1 | 1/2007 | Aring et al. | |
| 2009/0266739 | A1 | 10/2009 | Kindig | |
| 2011/0185682 | A1 * | 8/2011 | Rockwell et al. | 53/461 |

* cited by examiner

MACHINERY PACKAGING SYSTEM

BACKGROUND

1. Field

The disclosure relates generally to packaging systems and more specifically to packaging systems utilizing removable durable shipping material secured outside of shipped machinery.

2. Description of the Related Art

When a high-end information technology (IT) machine, such as a mainframe server and large data storage system, is purchased or leased, the machine is typically delivered to the client by shipment in a wooden crate or box. Within the crate or box, the machine is further secured in place using a variety of packing materials, such as styrofoam, foam, bubble wrap, and corrugated cardboard. Upon arrival, the machine is unpacked and clients are faced with the problem of either storing or disposing of two levels of shipping materials; the external packaging component and the internal packaging components. Because the useful life of high-end machines is fairly long, clients typically choose to dispose of the packing materials.

Unfortunately, when the client needs to return the machine at the end of a lease or has to move the machine between locations during usage or when transferring ownership, the proper protective shipping materials are not available. The result is that the machine is often damaged in shipping or movement because inappropriate or insufficient packing materials are used.

SUMMARY

According to one embodiment of the present invention, a packaging system, and method for packaging a piece of machinery are provided. A first corner bracket is extended from a first exterior edge of the machinery. The first corner bracket comprises a first baseplate positioned along a bottom plane of the machinery, and a first plurality of side plates. Each of the first plurality of side plates is integrally attached to the first baseplate at a first angle. Each of the first plurality of side plates extends upwardly from the baseplate. Each of the first plurality of side plates is integrally attached to at least one other of the first plurality of side plates. The first plurality of side plates form a first interior edge that mates to the first exterior edge of the machinery.

A second corner bracket is extended from a second exterior edge of the machinery. A second corner bracket comprises a second baseplate positioned along the bottom plane to the machinery, and a second plurality of side plates. Each of the second plurality of side plates is integrally attached to the second baseplate at the first angle. Each of the second plurality of side plates extends upwardly from the baseplate. Each of the second plurality of side plates is integrally attached to at least one other of the second plurality of side plates. The second plurality of side plates form a second interior edge that mates to the second exterior edge of the machinery.

A planar packing material is positioned along a first side of the machinery. The first side of the machinery is bounded by the bottom plane, the first plurality of side plates, and the second plurality of side plates. The planar packing material has a first end located proximate to the first corner bracket, and a second end located proximate to the second corner bracket. The planar packing material extends upwardly from the first baseplate and the second baseplate at the first angle. The first baseplate and the second baseplate fixedly support the planar packing material along the bottom plane. The first plurality of side plates fixedly supports the first end of the planar packing material. The second plurality of side plates fixedly supports the second end of the planar packing material.

The planar packing material is secured along a top plane with a first end-cap bracket from the first exterior edge of the machinery. The first end-cap bracket comprises a first top-plate positioned parallel to the top plane, and a first plurality of side caps. Each of the first plurality of side caps is integrally attached to the first top-plate at a second angle and extends downwardly from the first top-plate. The first angle and the second angle are supplementary. Each of the first plurality of side caps is integrally attached to at least one other of the first plurality of side caps. The first plurality of side plates form a first interior edge that mates to the first exterior edge of the machinery. The second plurality of side caps further secures the second plurality of side plates along the second edge of the machinery.

The planar packing material is secured along the top plane with a second end-cap bracket from the first exterior edge of the machinery. The second end-cap bracket comprises a second top-plate positioned parallel to the top plane, and a second plurality of side caps. Each of the second plurality of side caps is integrally attached to the second top-plate at the second angle and extends downwardly from the second top-plate. The first angle and the second angle are supplementary. Each of the second plurality of side caps is integrally attached to at least one other of the second plurality of side caps. The second plurality of side caps form a first interior edge that mates to the first exterior edge of the machinery. The second plurality of side caps further secures the second plurality of side plates along the second edge of the machinery.

DETAILED DESCRIPTION

Figure 1:
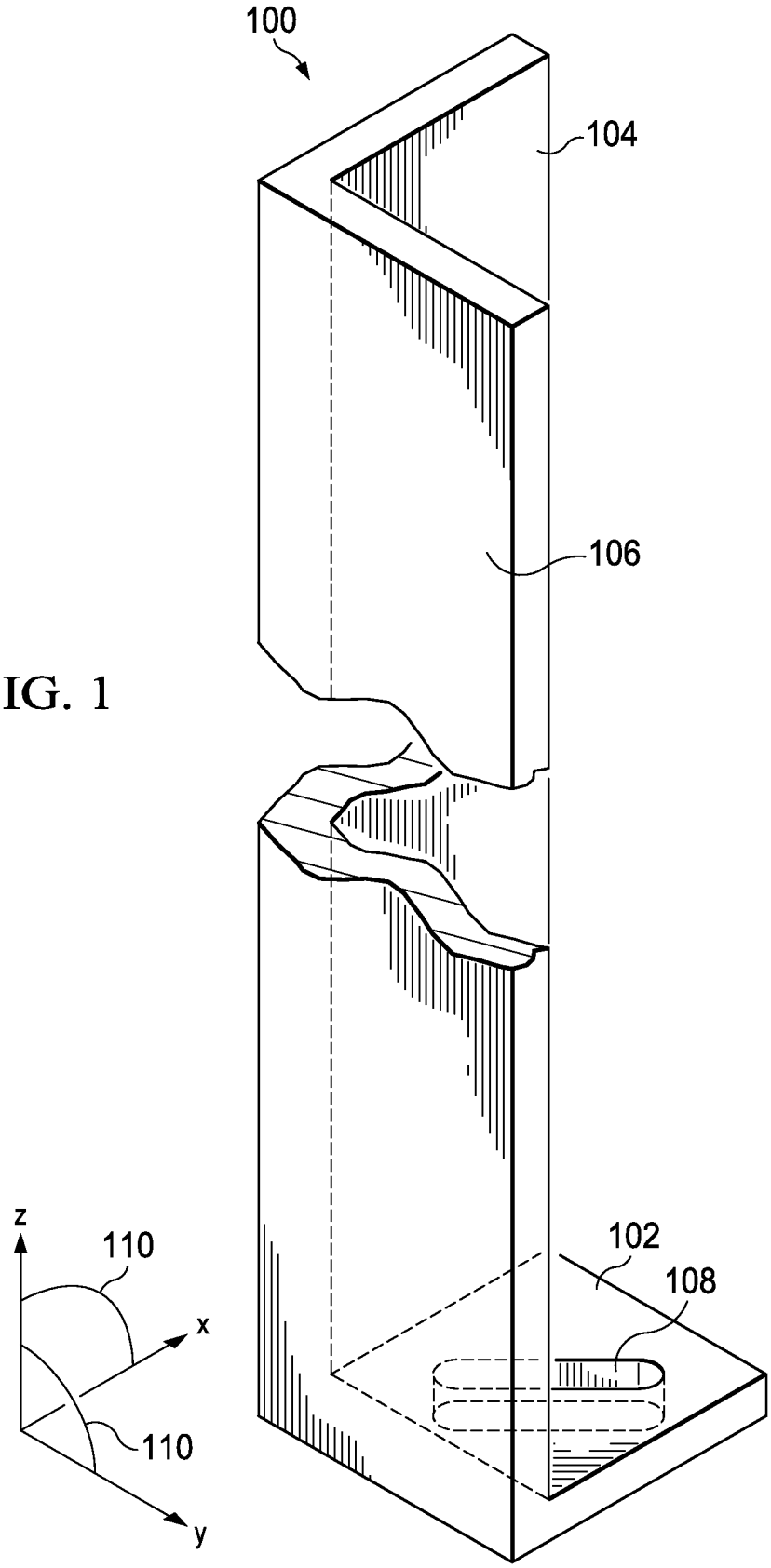
FIG. 1 is a corner support bracket according to an illustrative embodiment.

The illustrative embodiments described herein provide a packaging system and method for packaging a piece of machinery. A first corner bracket is extended from a first exterior edge of the machinery. The first corner bracket comprises a first baseplate positioned along a bottom plane and a first plurality of side plates. Each of the first plurality of side plates is integrally attached to the first baseplate at a first angle. Each of the first plurality of side plates extends upwardly from the baseplate. Each of the first plurality of side plates is integrally attached to at least one other of the first plurality of side plates. The first plurality of side plates form a first interior edge that mates to the first exterior edge of the machinery.

A second corner bracket is extended from a second exterior edge of the machinery. A second corner bracket comprises a second baseplate positioned along the bottom plane and a second plurality of side plates. Each of the second plurality of side plates is integrally attached to the second baseplate at the first angle. Each of the second plurality of side plates extends upwardly from the baseplate. Each of the second plurality of side plates is integrally attached to at least one other of the second plurality of side plates. The second plurality of side plates form a second interior edge that mates to the second exterior edge of the machinery.

A planar packing material is positioned along a first side of the machinery. The first side of the machinery is bounded by the bottom plane, the first plurality of side plates, and the second plurality of side plates. The planar packing material has a first end located proximate to the first corner bracket and a second end located proximate to the second corner bracket. The planar packing material extends upwardly from the first baseplate and the second baseplate at the first angle. The first baseplate and the second baseplate fixedly support the planar packing material along the bottom plane. The first plurality of side plates fixedly supports the first end of the planar packing material. The second plurality of side plates fixedly supports the second end of the planar packing material.

The planar packing material is secured along a top plane with a first end-cap bracket from the first exterior edge of the machinery. The first end-cap bracket comprises a first top-plate positioned parallel to the top plane and a first plurality of side caps. Each of the first plurality of side caps is integrally attached to the first top-plate at a second angle and extends downwardly from the first top-plate. The first angle and the second angle are supplementary. Each of the first plurality of side caps is integrally attached to at least one other of the first plurality of side caps. The first plurality of side plates form a first interior edge that mates to the first exterior edge of the machinery. The second plurality of side caps further secures the second plurality of side plates along the second edge of the machinery.

The planar packing material is secured along the top plane with a second end-cap bracket from the first exterior edge of the machinery. The second end-cap bracket comprises a second top-plate positioned parallel to the top plane and a second plurality of side caps. Each of the second plurality of side caps is integrally attached to the second top-plate at the second angle and extends downwardly from the second top-plate. The first angle and the second angle are supplementary. Each of the second plurality of side caps is integrally attached to at least one other of the second plurality of side caps. The second plurality of side caps form a first interior edge that mates to the first exterior edge of the machinery. The second plurality of side caps further secures the second plurality of side plates along the second edge of the machinery.

Referring now to FIG. 1, a corner support bracket is shown according to an illustrative embodiment. Corner support bracket 100 can be made from any durable material, including but not limited to metals, composites, plastics, resins, or other suitable material. In one illustrative embodiment, corner support bracket 100 is made from a material identical to that of an outer casing of the machinery.

Corner support bracket 100 includes baseplate 102, and a plurality of side plates, such as side plate 104 and side plate 106. Baseplate 102 is configured to align with a bottom plane of the machinery while side plate 104 and side plate 106 are configured at angle 110 to align parallel with sides of the machinery. Baseplate 102 is integrally affixed to each of the plurality of side plates. Additionally, each of the plurality of side plates is integrally affixed to at least one other of the plurality of side plates. In one illustrative embodiment, side plate 104 is integrally affixed to side plate 106.

Corner support bracket 100 includes elongated bolt hole 108. Elongated bolt hole 108 allows for corner support bracket 100 to be adjustably attached to the machinery. Elongated bolt hole 108 is preferably aligned within baseplate 102 at an angle that bisects the angle created by outermost ones of the plurality of side plates. In the illustrative example, elongated bolt hole 108 is aligned within baseplate 102 at an angle that bisects the angle created by side plate 104 and side plate 106. By aligning elongated bolt hole 108 at an angle that bisects the angle created by side plate 104 and side plate 106, packing material of similar thickness can be used. However, if additional packing material is desired on one face of the machinery, the alignment of elongated bolt hole 108 within baseplate 102 can be adjusted accordingly.

Figure 2:
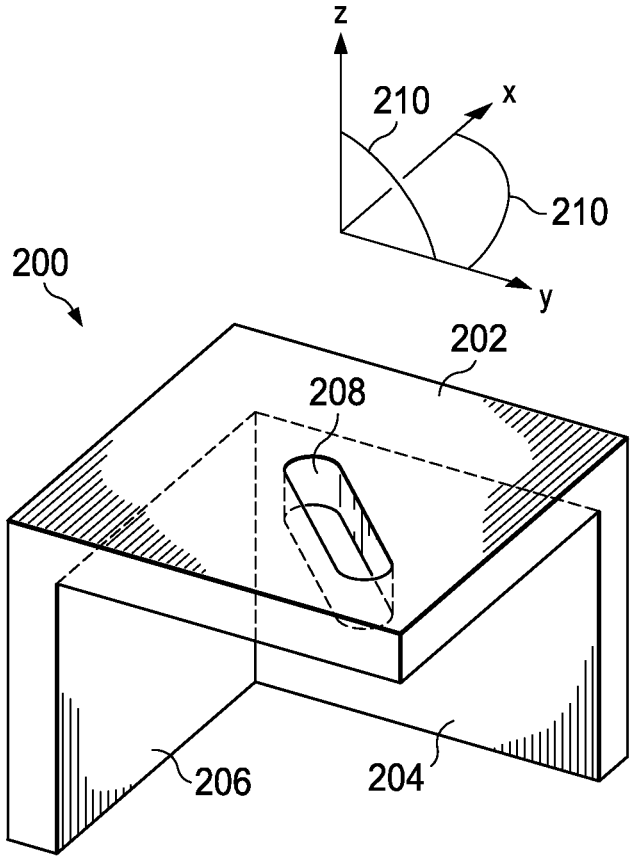
FIG. 2 is a corner end-cap bracket according to an illustrative embodiment.

Referring now to FIG. 2, a corner end-cap bracket is shown according to an illustrative embodiment. Corner end-cap bracket 200 can be made from any durable material, including but not limited to metals, composites, plastics, resins, or other suitable material. In one illustrative embodiment, corner support bracket is made from a material identical to that of an outer casing of the machinery.

Corner end-cap bracket 200 includes top-plate 202, a plurality of side caps, such as side cap 204 and side cap 206. Top-plate 202 is configured to align with a top plane of the machinery while side cap 204 and side cap 206 are configured at angle 210 to align parallel with sides of the machinery. In one illustrative embodiment, angle 210 is supplemental to angle 110 of FIG. 1. Top-plate 202 is integrally affixed to each of the plurality of side caps. Additionally, each of the plurality of side caps is integrally affixed to at least one other of the plurality of side caps. In one illustrative embodiment, side cap 204 is integrally affixed to side plate 206.

Corner end-cap bracket 200 includes elongated bolt hole 208. Elongated bolt hole 208 allows for corner end-cap bracket 200 to be adjustably attached to the machinery. Elongated bolt hole 208 is preferably aligned within top-plate 202 at an angle that bisects the angle created by outermost ones of the plurality of side caps. In the illustrative example, elongated bolt hole 208 is aligned within top-plate 202 at an angle that bisects the angle created by side cap 204 and side cap 206. By aligning elongated bolt hole 208 at an angle that bisects the angle created by side cap 204 and side cap 206, packing material of similar thickness can be used. However, if additional packing material is desired on one face of the machinery, the alignment of elongated bolt hole 208 within top-plate 202 can be adjusted accordingly.

Figure 3:
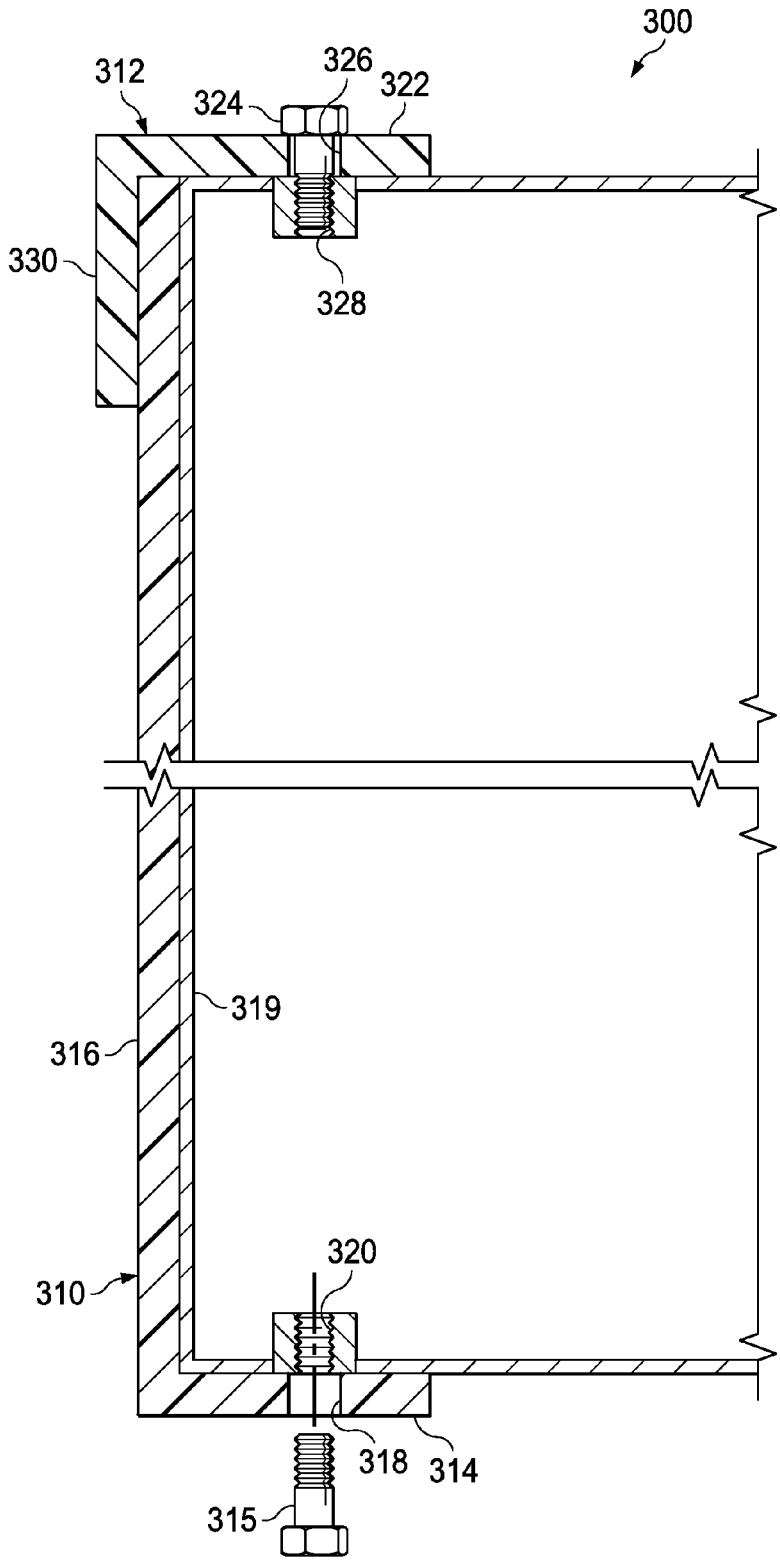
FIG. 3 is a corner support bracket and a corner end-cap bracket shown in a retracted configuration according to an illustrative embodiment.

Referring now to FIG. 3, a corner support bracket and a corner end-cap bracket are shown in a retracted configuration according to an illustrative embodiment. Corner support bracket 310 is corner support bracket 100 of FIG. 1. Corner end-cap bracket 312 is corner end-cap bracket 200 of FIG. 2.

Corner support bracket 310 includes baseplate 314. Baseplate 314 is baseplate 102 of FIG. 1. Baseplate 314 substantially abuts a bottom plane of machinery 300. Baseplate 314 is attached to machinery 300 with fastener 315. Fastener 315 is inserted through elongated bolt hole 318 and attached to machinery 300 at fastener receiver 320. Elongated bolt hole 318 is elongated bolt hole 108 of FIG. 1.

Corner support bracket 310 includes side plate 316. Side plate 316 is a side plate, such as one of side plate 104 and side plate 106 of FIG. 1. When corner support bracket 310 is in the retracted position, side plate 316 substantially abuts edge 319 of machinery 300.

Corner end-cap bracket 312 includes top-plate 322. Top-plate 322 is top-plate 202 of FIG. 2. Top-plate 322 substantially abuts a top plane of machinery 300. Top-plate 322 is attached to machinery 300 with fastener 324. Fastener 324 is inserted through elongated bolt hole 326 and attached to machinery 300 at fastener receiver 328. Elongated bolt hole 326 is elongated bolt hole 208 of FIG. 2.

Corner end-cap bracket 312 includes side cap 330. Side cap 330 is a side cap, such as one of side cap 204 and side cap 206 of FIG. 2. When corner end-cap bracket 312 is in the retracted position, side cap 330 overlaps and substantially abuts side plate 316 of corner support bracket 310.

Figure 4:
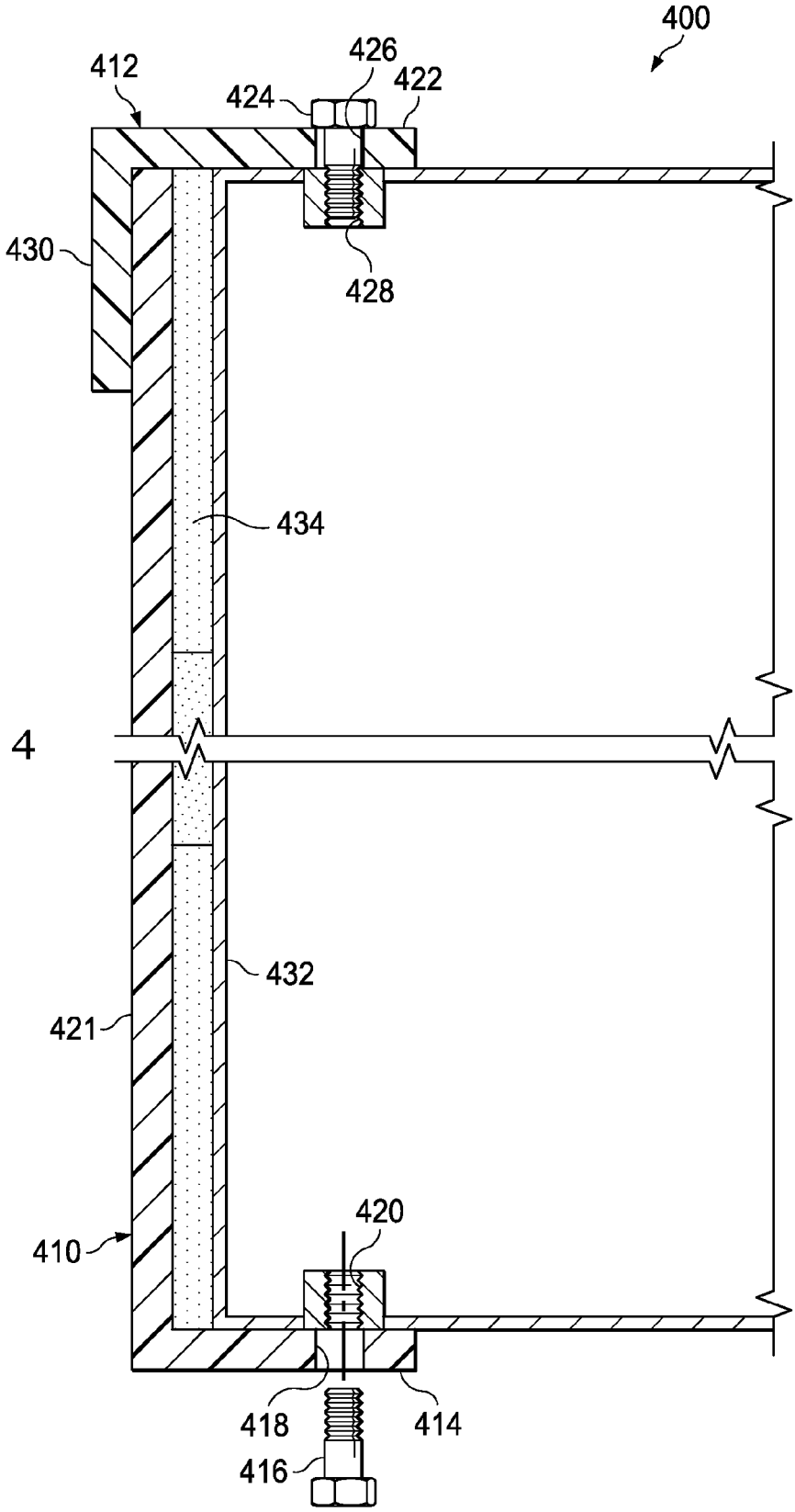
FIG. 4 is a corner support bracket and a corner end-cap bracket shown in an extended configuration according to an illustrative embodiment.

Referring now to FIG. 4, a corner support bracket and a corner end-cap bracket are shown in an extended configuration according to an illustrative embodiment. Corner support bracket 410 is corner support bracket 100 of FIG. 1. Corner end-cap bracket 412 is corner end-cap bracket 200 of FIG. 2.

Corner support bracket 410 includes baseplate 414. Baseplate 414 is baseplate 102 of FIG. 1. Baseplate 414 substantially abuts a bottom plane of machinery 400. Baseplate 414 is attached to machinery 400 with fastener 416. Fastener 416 is inserted through elongated bolt hole 418 and attached to machinery 400 at fastener receiver 420. Elongated bolt hole 418 is elongated bolt hole 108 of FIG. 1.

Corner support bracket 410 includes side plate 421. Side plate 421 is a side plate, such as one of side plate 104 and side plate 106 of FIG. 1.

Corner end-cap bracket 412 includes top-plate 422. Top-plate 422 is top-plate 202 of FIG. 2. Top-plate 422 substantially abuts a top plane of machinery 400. Top-plate 422 is attached to machinery 400 with fastener 424. Fastener 424 is inserted through elongated bolt hole 426 and attached to machinery 400 at fastener receiver 428. Elongated bolt hole 426 is elongated bolt hole 208 of FIG. 2.

Corner end-cap bracket 412 includes side cap 430. Side cap 430 is a side cap, such as one of side cap 204 and side cap 206 of FIG. 2.

Corner support bracket 410 and corner end-cap bracket 412 are shown in the extended position. When corner support bracket 410 is in the extended position, a space between side plate 421 and edge 432 of machinery 400 allows for packaging material 434 to be inserted between side plate 421 and edge 432. When corner end-cap bracket 412 is in the extended position, side cap 430 overlaps and substantially abuts side plate 421 of corner support bracket 410.

Figure 5:
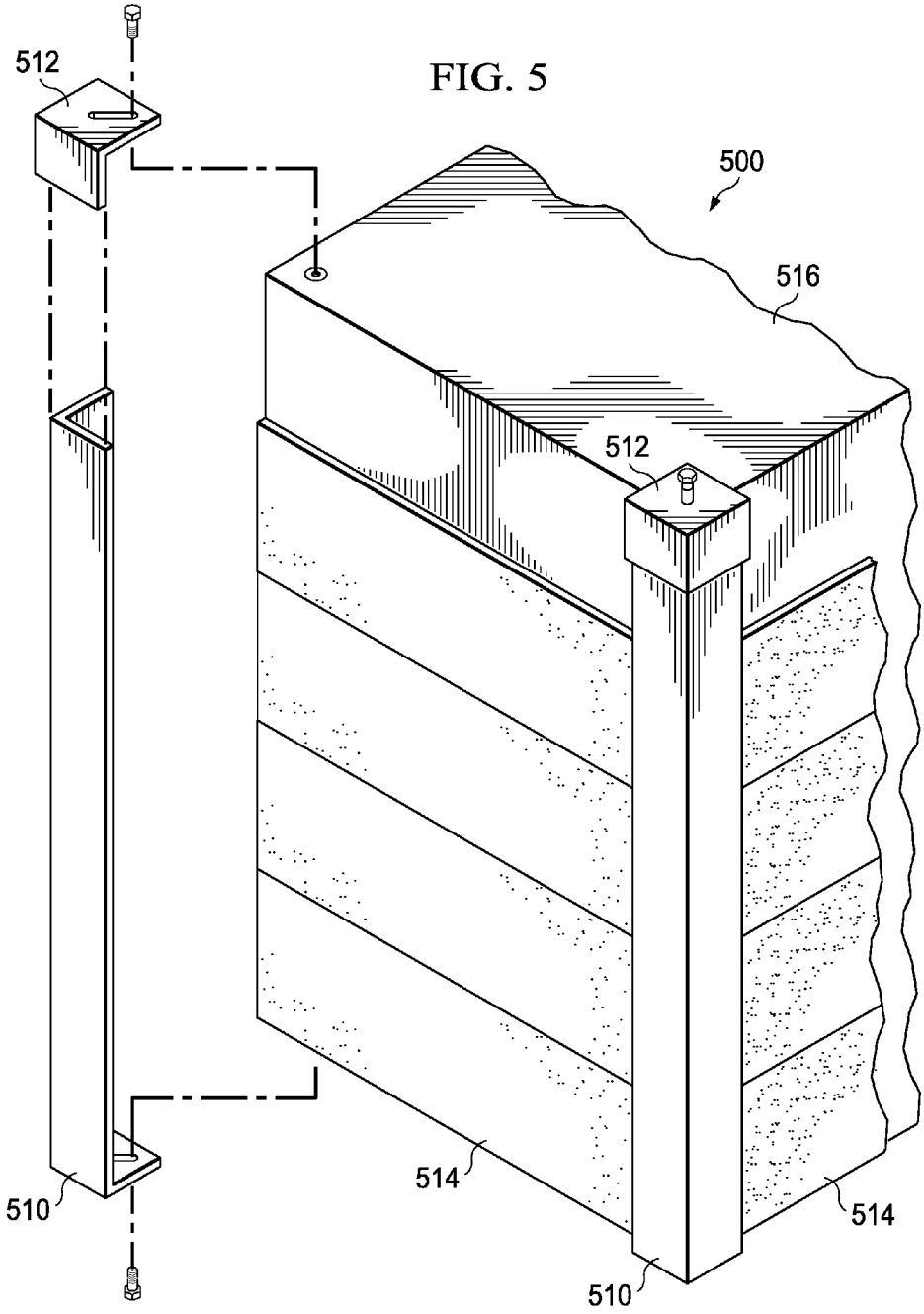
FIG. 5 is an isometric view of the packaging system according to an illustrative embodiment.

Referring now to FIG. 5, an isometric view of the packaging system is shown according to an illustrative embodiment. Packaging system 500 is shown with corner support bracket 510 and corner end-cap bracket 512 in an extended position.

Packaging system 500 includes corner support bracket 510. Corner support bracket 510 is corner support bracket 100 of FIG. 1.

Packaging system 500 includes corner end-cap bracket 512. Corner end-cap bracket 512 is corner end-cap bracket 200 of FIG. 2.

Corner support bracket 510 and corner end-cap bracket 512 are shown in the extended position. When corner support bracket 510 is in the extended position, a space between its side plate and machinery 516 allows for packaging material 514 to be inserted between side plate of corner support bracket 510 and machinery 516 being packaged. When corner end-cap bracket 512 is in the extended position, its side cap overlaps and substantially abuts the side plate of corner support bracket 510.

Packaging system 500 includes packaging material 514. Packaging material 514 can be any material held between corner support bracket 510 and the machinery being packaged. Packaging material 514 protects the housing of the machinery being packaged from damage that might occur during the shipping of the machine. Preferably, packaging material 514 is a durable material capable of withstanding incidental contacts, abrasions, and impacts that might occur during the shipping of the machine. In one illustrative embodiment, packaging material 514 is a material that can be saved after initial shipment and reused when the machinery needs to shipped again or stored. Packaging material 514 can be, for example, but not limited to metals, composites, plastics, resins, wood, corrugated cardboard, foam, or other suitable material.

Figure 6:
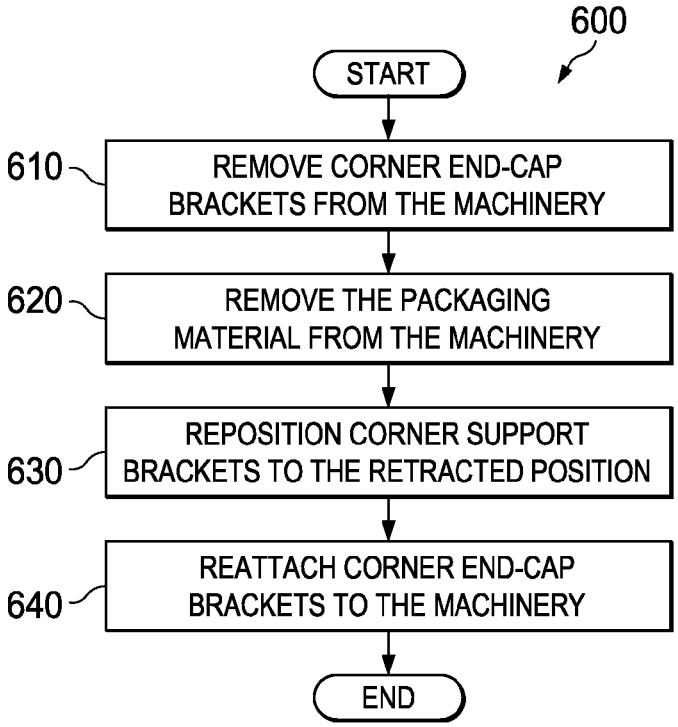
FIG. 6 is a flowchart for unpacking a machinery according to an illustrative embodiment.

Referring now to FIG. 6, a flowchart for unpacking a machinery is shown according to an illustrative embodiment. Process 600 is a process for unpacking a machinery using a packaging system, such as packaging system 500 of FIG. 5.

Corner end-cap brackets are removed from the machinery (step 610). End-cap brackets are in an extended configuration. In one illustrative embodiment, a top-plate, such as top-plate 202 of FIG. 2 substantially abuts a top plane of the machine. The top-plate is attached to the machinery with a fastener inserted through an elongated bolt hole of the top-plate. The fastener is secured to the machinery at a fastener receiver, such as fastener receiver 328 of FIG. 3. Corner end-cap brackets are removed from the machinery by first removing the fasteners from the fastener receiver. Once the fasteners are removed, the corner end-cap brackets can be removed.

The packaging material is then removed from the machinery (step 620). The packaging material can be packaging material 514 of FIG. 5. Packaging material is secured around the machinery by corner support brackets, such as corner support bracket 100 of FIG. 1. In one illustrative embodiment, the packaging material is removed by upwardly sliding the packaging material to exit the space between the corner support brackets and the machine.

Corner support brackets are then repositioned to the retracted position (step 630). The corner support brackets are initially in the extended position. In one illustrative embodiment, a baseplate, such as baseplate 102 of FIG. 1 substantially abuts a bottom plane of the machine. The baseplate is attached to the machinery with a fastener inserted through an elongated bolt hole of the baseplate. The fastener is secured to the machinery at a fastener receiver, such as fastener receiver 320 of FIG. 3. Corner support brackets are repositioned to the retracted position by first removing or loosening the fasteners from the fastener receiver. Once the fasteners are removed or loosened, the corner support brackets can be repositioned to the retracted position by sliding the corner support brackets along the elongated bolt hole toward the machinery such that the corner support brackets substantially abut the machine. Once the corner support brackets have been repositioned, the fasteners are reinserted or tightened to hold the corner support brackets in the retracted position.

Next, corner end-cap brackets are reattached to the machinery (step 640) with the process terminating thereafter. Fasteners are reinserted through the top-plates of the corner end-cap brackets. The corner end-cap brackets are then repositioned into the retracted configuration by sliding the corner end-cap bracket along the elongated bolt hole toward the machinery such that the corner end-cap brackets substantially abut the corner support brackets. Once the corner support brackets have been repositioned, the fasteners are reinserted or tightened to hold the corner end-cap brackets in the retracted position.

Figure 7:
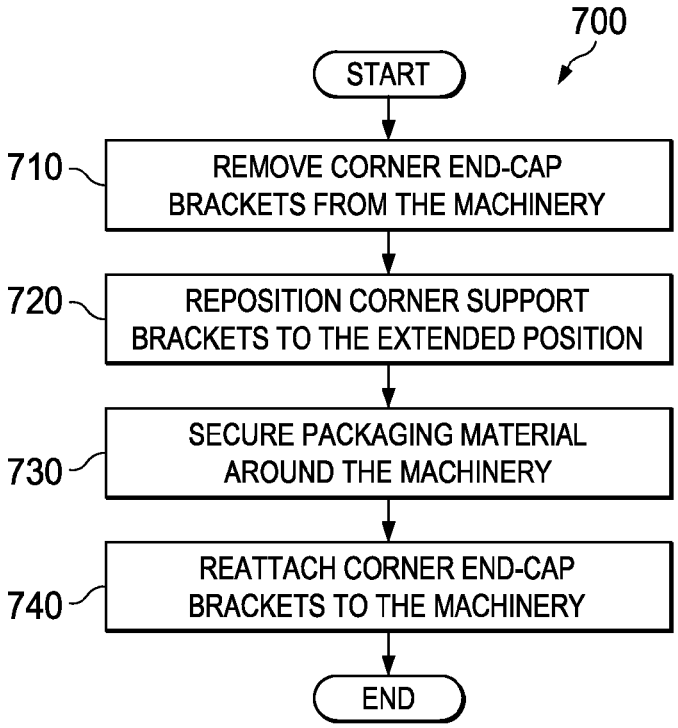
FIG. 7 is a flowchart for packaging a machinery according to an illustrative embodiment.

Referring now to FIG. 7, a flowchart for packaging a machinery is shown according to an illustrative embodiment. Process 700 is a process for packaging machinery using a packaging system, such as packaging system 500 of FIG. 5.

Corner end-cap brackets are removed from the machinery (step 710). End-cap brackets are in a retracted configuration. In one illustrative embodiment, a top-plate, such as top-plate 202 of FIG. 2 substantially abuts a top plane of the machine. The top-plate is attached to the machinery with a fastener inserted through an elongated bolt hole of the top-plate. The fastener is secured to the machinery at a fastener receiver, such as fastener receiver 328 of FIG. 3. Corner end-cap brackets are removed from the machinery by first removing the fasteners from the fastener receiver. Once the fasteners are removed, the corner end-cap brackets can be removed.

Corner support brackets are then repositioned to the extended position (step 720). The corner support brackets are initially in the retracted position. In one illustrative embodiment, a baseplate, such as baseplate 102 of FIG. 1 substantially abuts a bottom plane of the machine. The baseplate is attached to the machinery with a fastener inserted through an elongated bolt hole of the baseplate. The fastener is secured to the machinery at a fastener receiver, such as fastener receiver 320 of FIG. 3. Corner support brackets are repositioned to the extended position by first removing or loosening the fasteners from the fastener receiver. Once the fasteners are removed or loosened, the corner support brackets can be repositioned to the extended position by sliding the corner support brackets along the elongated bolt hole away from the machinery such that a space is formed between the corner support brackets and the machine. Once the corner support brackets have been repositioned, the fasteners are reinserted or tightened to hold the corner support brackets in the extended position.

Packaging material is then secured around the machinery (step 730). The packaging material can be packaging material 514 of FIG. 5. Packaging material is secured around the machinery by corner support brackets, such as corner support bracket 100 of FIG. 1. In one illustrative embodiment, the packaging material is secured by downwardly sliding the packaging material into the space between the corner support brackets and the machine. The packaging material is secured along a base plane of the machinery by baseplates of the corner support brackets. A first end of the packaging material is secured by side plates of a first corner support bracket, while a distal end of the packaging material is secured by side plates of a second corner support bracket.

Next, corner end-cap brackets are reattached to the machinery (step 740) with the process terminating thereafter. Fasteners are reinserted through the top-plates of the corner end-cap brackets. The corner end-cap brackets are then repositioned into the extended configuration by sliding the corner end-cap bracket along the elongated bolt holes such that the corner end-cap brackets substantially abut the corner support brackets. Once the corner support brackets have been repositioned, the fasteners are reinserted or tightened to hold the corner end-cap brackets in the extended position.

Thus, the illustrative embodiments described herein provide a packaging system and method for packaging a piece of machinery. A first corner bracket is extended from a first exterior edge of the machinery. The first corner bracket comprises a first baseplate positioned along a bottom plane and a first plurality of side plates. Each of the first plurality of side plates is integrally attached to the first baseplate at a first angle. Each of the first plurality of side plates extends upwardly from the baseplate. Each of the first plurality of side plates is integrally attached to at least one other of the first plurality of side plates. The first plurality of side plates form a first interior edge that mates to the first exterior edge of the machinery.

A second corner bracket is extended from a second exterior edge of the machinery. A second corner bracket comprises a second baseplate positioned along the bottom plane and a second plurality of side plates. Each of the second plurality of side plates is integrally attached to the second baseplate at the first angle. Each of the second plurality of side plates extends upwardly from the baseplate. Each of the second plurality of side plates is integrally attached to at least one other of the second plurality of side plates. The second plurality of side plates form a second interior edge that mates to the second exterior edge of the machinery.

A planar packing material is positioned along a first side of the machinery. The first side of the machinery is bounded by the bottom plane, the first plurality of side plates, and the second plurality of side plates. The planar packing material has a first end located proximate to the first corner bracket and a second end located proximate to the second corner bracket. The planar packing material extends upwardly from the first baseplate and the second baseplate at the first angle. The first baseplate and the second baseplate fixedly support the planar packing material along the bottom plane. The first plurality of side plates fixedly supports the first end of the planar packing material. The second plurality of side plates fixedly supports the second end of the planar packing material.

The planar packing material is secured along a top plane with a first end-cap bracket from the first exterior edge of the machinery. The first end-cap bracket comprises a first top-plate positioned parallel to the top plane and a first plurality of side caps. Each of the first plurality of side caps is integrally attached to the first top-plate at a second angle and extends downwardly from the first top-plate. The first angle and the second angle are supplementary. Each of the first plurality of side caps is integrally attached to at least one other of the first plurality of side caps. The first plurality of side plates form a first interior edge that mates to the first exterior edge of the machinery. The second plurality of side caps further secures the second plurality of side plates along the second edge of the machinery.

The planar packing material is secured along the top plane with a second end-cap bracket from the first exterior edge of the machinery. The second end-cap bracket comprises a second top-plate positioned parallel to the top plane and a second plurality of side caps. Each of the second plurality of side caps is integrally attached to the second top-plate at the second angle and extends downwardly from the second top-plate. The first angle and the second angle are supplementary. Each of the second plurality of side caps is integrally attached to at least one other of the second plurality of side caps. The second plurality of side caps form a first interior edge that mates to the first exterior edge of the machinery. The second plurality of side caps further secures the second plurality of side plates along the second edge of the machinery.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A method for packaging machinery, the method comprising:

extending a first corner bracket from a first exterior edge of the machinery, the first corner bracket comprising a first baseplate positioned along a bottom plane and a first plurality of side plates, each of the first plurality of side plates being integrally attached to the first baseplate at a first angle and extending upwardly therefrom, wherein each of the first plurality of side plates is attached to one another, wherein the first plurality of side plates form a first interior edge that mates to the first exterior edge of the machinery;

extending a second corner bracket from a second exterior edge of the machinery, the second corner bracket comprising a second baseplate positioned along the bottom plane and a second plurality of side plates, each of the second plurality of side plates being integrally attached to the second baseplate at the first angle and extending upwardly therefrom, wherein each of the second plurality of side plates is attached to one another, wherein the second plurality of side plates form a second interior edge that mates to the second exterior edge of the machinery;

positioning a planar packing material along a first side of the machinery, wherein the first side of the machinery is bounded by the bottom plane, the first plurality of side plates, and the second plurality of side plates, wherein the planar packing material has a first end located proximate to the first corner bracket and a second end located proximate to the second corner bracket, and wherein the planar packing material extends upwardly from the first baseplate and the second baseplate at the first angle, wherein the first baseplate and the second baseplate fixedly supports the planar packing material along the bottom plane, wherein the first plurality of side plates fixedly supports the first end of the planar packing material and the second plurality of side plates fixedly supports the second end of the planar packing material;

securing the planar packing material along a top plane with a first end-cap bracket from the first exterior edge of the machinery, the first end-cap bracket comprises a first top-plate positioned parallel to the top plane and a first plurality of side caps, each of the first plurality of side caps being integrally attached to the first top-plate at a second angle and extending downwardly therefrom, wherein each of the first plurality of side caps is attached to one another, wherein the first plurality of side caps form a third interior edge that mates to the first plurality of side plates, and wherein the first plurality of side caps further secures the first plurality of side plates along the first exterior edge of the machinery; and further securing the planar packing material along the top plane with a second end-cap bracket from the second exterior edge of the machinery, the second end-cap bracket comprising a second top-plate positioned parallel to the top plane and a second plurality of side caps, each of the second plurality of side caps being integrally attached to the second top-plate at the second angle and extending downwardly therefrom, wherein each of the second plurality of side caps is attached to one another, wherein the second plurality of side caps form a fourth interior edge that mates to the second plurality of side plates, and wherein the second plurality of side caps further secures the second plurality of side plates along the second exterior edge of the machinery.

2. The method of claim 1 further comprising:

extending the first corner bracket from the first exterior edge of the machinery, each of the first plurality of side plates being integrally attached to the first baseplate at the first angle; and securing the planar packing material along the top plane with the first end-cap bracket from the first exterior edge of the machinery, each of the first plurality of side caps being integrally attached to the first top-plate at the second angle, wherein the first angle and the second angle are supplementary angles.

3. The method of claim 1 further comprising:

extending the first corner bracket from the first exterior edge of the machinery along a first elongated bolt hole within the first baseplate, wherein the first elongated bolt hole bisects an angle created by the first plurality of side plates; and extending the second corner bracket from the second exterior edge of the machinery along a second elongated bolt hole within the second baseplate, wherein the second elongated bolt hole bisects an angle created by the second plurality of side plates.

4. The method of claim 3 further comprising:

securing the planar packing material along the top plane with the first end-cap bracket from the first exterior edge of the machinery, wherein the first end-cap bracket is secured to the machinery via a third elongated bolt hole within the first top-plate, wherein the third elongated bolt hole bisects an angle created by the first plurality of side caps; and securing the planar packing material along the top plane with the second end-cap bracket from the second exterior edge of the machinery, wherein the second end-cap bracket is secured to the machinery via a fourth elongated bolt hole within the second top-plate, wherein the fourth elongated bolt hole bisects an angle created by the second plurality of side caps.

5. The method of claim 1, wherein the planar packing material comprises packaging material selected from a group consisting of metal packaging material, composite packaging material, plastic packaging material, resin packaging material, wood packaging material, corrugated cardboard packaging material, and foam packaging material.

6. The method of claim 1 further comprising:

extending a third corner bracket from a third exterior edge of the machinery, the third corner bracket comprising a third baseplate positioned along the bottom plane and a third plurality of side plates, each of the third plurality of side plates being integrally attached to the third baseplate at a third angle and extending upwardly therefrom, wherein each of the third plurality of side plates is attached to one another, wherein the third plurality of side plates form a fifth interior edge that mates to the third exterior edge of the machinery;

positioning a second planar packing material along a second side of the machinery, wherein the second side of the machinery is bounded by the bottom plane, the second plurality of side plates, and the third plurality of side plates, wherein the second planar packing material has a first end located proximate to the second corner bracket, and a second end located proximate to the third corner bracket, and wherein the second planar packing material extends upwardly from the second baseplate and the third baseplate at the third angle, wherein the second baseplate and the third baseplate fixedly supports the second planar packing material along the bottom plane, wherein the second plurality of side plates fixedly supports the first end of the second planar packing material and the third plurality of side plates fixedly supports the second end of the second planar packing material; and securing the second planar packing material along the top plane with a third end-cap bracket from the third exterior edge of the machinery, the third end-cap bracket comprises a third top-plate positioned parallel to the top plane and a third plurality of side caps, each of the third plurality of side caps being integrally attached to the third top-plate at a fourth angle and extending downwardly therefrom, wherein each of the third plurality of side caps is attached to one another, wherein the third plurality of side caps form a sixth interior edge that mates to the third plurality of side plates, and wherein the third plurality of side caps further secures the third plurality of side plates along the third exterior edge of the machinery.

7. The method of claim 6 further comprising:

extending the third corner bracket from the third exterior edge of the machinery, each of the third plurality of side plates being integrally attached to the third baseplate at the third angle; and extending the third end-cap bracket from the third exterior edge of the machinery, each of the third plurality of side caps being integrally attached to the third top-plate at the fourth angle, wherein the third angle and the fourth angle are supplementary angles.

8. A packaging system comprising:

a first corner bracket extendibly attached to a first exterior edge of a machinery the first corner bracket comprising a first baseplate positioned along a bottom plane, and a first plurality of side plates, each of the first plurality of side plates being integrally attached to the first baseplate at a first angle and extending upwardly therefrom, wherein each of the first plurality of side plates is integrally attached to at least one other of the first plurality of side plates, wherein the first plurality of side plates form a first interior edge that mates to the first exterior edge of the machinery;

a second corner bracket extendibly attached to a second exterior edge of the machinery, the second corner bracket comprising a second baseplate positioned along the bottom plane, and a second plurality of side plates, each of the second plurality of side plates being integrally attached to the second baseplate at the first angle and extending upwardly therefrom, wherein each of the second plurality of side plates is integrally attached to at least one other of the second plurality of side plates, wherein the second plurality of side plates form a second interior edge that mates to the second exterior edge of the machinery;

a planar packing material positioned along a first side of the machinery, wherein the first side of the machinery is bounded by the bottom plane, the first plurality of side plates, and the second plurality of side plates, wherein the planar packing material has a first end located proximate to the first corner bracket, and a second end located proximate to the second corner bracket, and wherein the planar packing material extends upwardly from the first baseplate and the second baseplate at the first angle, wherein the first baseplate and the second baseplate fixedly supports the planar packing material along the bottom plane, wherein the first plurality of side plates fixedly supports the first end of the planar packing material and the second plurality of side plates fixedly supports the second end of the planar packing material;

a first end-cap bracket extendibly attached to the first exterior edge of the machinery at a top plane of the machinery, wherein the first end-cap bracket comprises a first top-plate positioned parallel to the top plane, and a first plurality of side caps, each of the first plurality of side caps being integrally attached to the first top-plate at a second angle and extending downwardly therefrom, wherein each of the first plurality of side caps is integrally attached to at least one other of the first plurality of side caps, wherein the first plurality of side plates form a first interior edge that mates to the first plurality of side plates, and wherein the first plurality of side caps further secures the second plurality of side plates along the second edge of the machinery; and a second end-cap bracket extendibly attached to the second exterior edge of the machinery at the top plane of the machinery, wherein the second end-cap bracket comprising a second top-plate positioned parallel to the top plane, and a second plurality of side caps, each of the second plurality of side caps being integrally attached to the second top-plate at the second angle and extending downwardly therefrom, wherein each of the second plurality of side caps is integrally attached to at least one other of the second plurality of side caps, wherein the second plurality of side caps form a first interior edge that mates to the second plurality of side plates, and wherein the second plurality of side caps further secures the second plurality of side plates along the second edge of the machinery.

9. The packaging system of claim 8 further comprising:

the first corner bracket extendibly attached to the first exterior edge of the machinery, each of the first plurality of side plates being integrally attached to the first baseplate at a first angle; and the second end-cap bracket extendibly attached to the second exterior edge of the machinery at the top plane of the machinery, each of the first plurality of side caps being integrally attached to the first top-plate at the second angle, wherein the first angle and the second angle are supplementary angles.

10. The packaging system of claim 8 further comprising:

the first corner bracket extendibly attached to the first exterior edge of the machinery along a first elongated bolt hole within the first baseplate, wherein the first elongated bolt hole bisects an angle created by the first plurality of side plates; and the second corner bracket extendibly attached to the second exterior edge of the machinery along a second elongated bolt hole within the second baseplate, wherein the second elongated bolt hole bisects an angle created by the second plurality of side plates.

11. The packaging system of claim 10 further comprising:

the first end-cap bracket extendibly attached to the first exterior edge of the machinery, wherein the first end-cap bracket is secured to the machinery via a third elongated bolt hole within the first top-plate, wherein the third elongated bolt hole bisects an angle created by the first plurality of side caps; and the second end-cap bracket extendibly attached to the second exterior edge of the machinery, wherein the second end-cap bracket is secured to the machinery via a fourth elongated bolt hole within the second top-plate, wherein the fourth elongated bolt hole bisects an angle created by the second plurality of side caps.

12. The packaging system of claim 8, wherein the planar packing material comprises packaging material selected from a group consisting of metal packaging material, composite packaging material, plastic packaging material, resin packaging material, wood packaging material, corrugated cardboard packaging material, and foam packaging material.

13. The packaging system of claim 8 further comprising:

a third corner bracket extendibly attached to third exterior edge of the machinery the third corner bracket comprising a third baseplate positioned along the bottom plane and a third plurality of side plates, each of the third plurality of side plates being integrally attached to the third baseplate at a third angle and extending upwardly therefrom, wherein each of the third plurality of side plates is integrally attached to at least one other of the third plurality of side plates, wherein the third plurality of side plates form a third interior edge that mates to the third exterior edge of the machinery;

a second planar packing material positioned along a second side of the machinery, wherein the second side of the machinery is bounded by the bottom plane the second plurality of side plates, and the third plurality of side plates, wherein the second planar packing material has a first end located proximate to the second corner bracket and a second end located proximate to the third corner bracket, and wherein the second planar packing material extends upwardly from the second baseplate and the third baseplate at the third angle, wherein the second baseplate and the third baseplate fixedly supports the second planar packing material along the bottom plane, wherein the second plurality of side plates fixedly supports the first end of the second planar packing material and the third plurality of side plates fixedly supports the second end of the second planar packing material; and a third end-cap bracket extendibly attached to the third exterior edge of the machinery at the top plane of the machinery, wherein the third end-cap bracket comprises a third top-plate positioned parallel to the top plane and a third plurality of side caps, each of the third plurality of side caps being integrally attached to the third top-plate at a fourth angle and extending downwardly therefrom, wherein each of the third plurality of side caps is integrally attached to at least one other of the third plurality of side caps, wherein the third plurality of side caps form a first interior edge that mates to the third plurality of side plates, and wherein the third plurality of side caps further secures the third plurality of side plates along the third edge of the machinery.

14. The packaging system of claim 13 further comprising:

the third corner bracket extendibly attached to the third exterior edge of the machinery, each of the third plurality of side plates being integrally attached to the third baseplate at the third angle; and the third end-cap bracket extendibly attached to the third exterior edge of the machinery, each of the third plurality of side caps being integrally attached to the third top-plate at the fourth angle, wherein the third angle and the fourth angle are supplementary angles.

* * * * *